United States Patent [19]

Wheeler et al.

[11] 4,446,713

[45] May 8, 1984

[54] APPARATUS AND METHOD FOR BENDING INSULATED PIPING

[75] Inventors: Lionel H. Wheeler, Houston, Tex.; Robert G. Goekler, Owasso, Okla.

[73] Assignee: Crutcher Resources Corporation, Houston, Tex.

[21] Appl. No.: 280,488

[22] Filed: Jul. 6, 1981

[51] Int. Cl.[3] ..... B21D 9/05

[52] U.S. Cl. ..... 72/308; 72/388

[58] Field of Search ..... 72/388, 389, 466, 392, 72/369, 386, 307, 308

[56] References Cited

U.S. PATENT DOCUMENTS

| | | | |
|---|---|---|---|
| 1,775,760 | 9/1930 | Harvey | 72/369 |
| 1,775,762 | 9/1930 | Harvey | 72/369 |
| 3,780,591 | 12/1973 | Clavin et al. | 72/466 |
| 3,834,210 | 9/1974 | Clavin et al. | 72/466 |
| 3,851,519 | 12/1974 | Calvin | 72/466 |
| 4,132,104 | 1/1979 | Clavin | 72/342 |
| 4,313,330 | 2/1982 | Cummings | 72/388 |

*Primary Examiner*—Gene P. Crosby

*Attorney, Agent, or Firm*—Richards, Harris & Medlock

[57] ABSTRACT

A pipe bending machine (10) is described which incorporates a bending die (14) which supports coated pipe during bending without damaging the coating. In one embodiment, the bending die (14) employs a conventional die (30) with a plurality of longitudinal rods (40, 42, 44) spaced from the inner surface of the die (30) and in pipe confronting relation. When the pipe is urged against the bending die in the machine, the rods precompress the material thereunder for transmitting the bending forces. The rods (40, 42, 44) are spaced a sufficient distance from each other in the transverse direction about the inner surface of the die to permit the material to flow outward therebetween to reduce the stresses in the coating. In a second embodiment, a plurality of transversely extending rings (62, 64 66) are positioned on the inner surface of a conventional die (30) which further act to support bending forces without damage to the coating. In a third embodiment, a series of rods (106–114) are radially supported within a bending die (80). The rods may be moved radially inward to compress the coating material thereunder to support the bending forces.

27 Claims, 10 Drawing Figures

APPARATUS AND METHOD FOR BENDING INSULATED PIPING

TECHNICAL FIELD

This invention relates to the bending of pipe, and in particular to bending pipe having an outer coating.

BACKGROUND ART

A pipe bending machine is commonly employed to bend pipe for installation in a pipeline or other use. To perform the bending operation, the pipe is typically secured in the machine by a fixed pinup shoe, a fixed die and a movable stiffback. Hydraulic cylinders are used to move the stiffback to bend the pipe about the bending die to the desired radius of curvature. The bending die typically has a compound surface, curved about the radius of the pipe and along its length to the desired curvature. The bending dies are typically interchangeable in the bending machine which permits the machine to be adapted for bending varied diameter pipe.

In many applications, it has become common to employ pipe having an insulation coating on its outer surface. One common application is the use of coating on pipe employed in artic regions. This coating insulates the pipe against ground frost heave and potential failure of the pipe. Another common use is in the transportation of heated oil for use in heat exchangers. One such coating is polyurethane. A 48 inch diameter pipe may, for example, have a five inch thick coating of polyurethane foam.

The bending of pipe having a compressible insulating material such as polyurethane thereon in a conventional bending machine has created several problems. The conventional bending die is designed to contact a large area of the pipe being bent. Therefore, the bending die tends to push the compressible material inward over a large surface area, causing adjacent areas of the material to balloon out and break away from the pipe. In addition, the compressibility of the coating material often uses much of the stroke of the hydraulic cylinders on the bending machine to merely compress the material without bending the pipe. In several applications, the upper surface of the bent pipe adjacent the bending die has been wrinkled from the compression effects of bending. This may be attributed to the failure of the bending die to adequately support the pipe during bending through the compressible material.

Therefore, a need has arisen for an apparatus and method for bending pipe having compressible material thereon without destruction of the compressible material or damage to the pipe.

DISCLOSURE OF THE INVENTION

In accordance with one aspect of the present invention, a bending die for use in a bending machine for pipe coated with a compressible material is provided. The bending machine includes structure for mounting the die on a bending die and a plurality of bars extending along the inner surface of the structure in pipe confronting relation for opposing bending forces through the compressible material. The bars are spaced apart to permit flow of the compressible material therebetween as the bending forces cause deformation of the compressible material.

In accordance with another aspect of the present invention, a method for bending pipe coated with a compressible material is provided. The method includes the steps of supporting the pipe against a bending die with a stiffback and pinup shoe. The bending die has a plurality of bars extending along its inner surface in pipe confronting relation for opposing bending forces. The method further includes the step of moving the stiffback to bend the pipe around the bending die, the bars being spaced apart to permit the flow of compressible material between the bars as the bending forces cause deformation of the compressible material.

In accordance with yet another aspect of the present invention, a bending die is provided which includes a plurality of rods extending longitudinally along the inner surface of a die structure. The rods are spaced apart laterally to permit flow of the compressible material therebetween when the bending forces deform the compressible material. A plurality of rings may be substituted for the rods. The rings are spaced along the length of the die and their inner pipe confronting surfaces define a curve corresponding to the desired radius of curvature in the pipe.

In accordance with yet another aspect of the present invention, a plurality of rods extend longitudinally along the inner surface of the die structure. The bars are movable radially to permit the pipe to be positioned within a bending machine. The rods are then moved radially inward to precompress the compressible material. The bars on opposed sides of the pipe adjacent the sides thereof may be pivoted to move with the compressible material as the pipe is bent.

BRIEF DESCRIPTION OF THE DRAWINGS

A more complete understanding of the invention may be had by reference to the following Detailed Description when taken in conjunction with the accompanying Drawings wherein.

DETAILED DESCRIPTION

Figure 1:
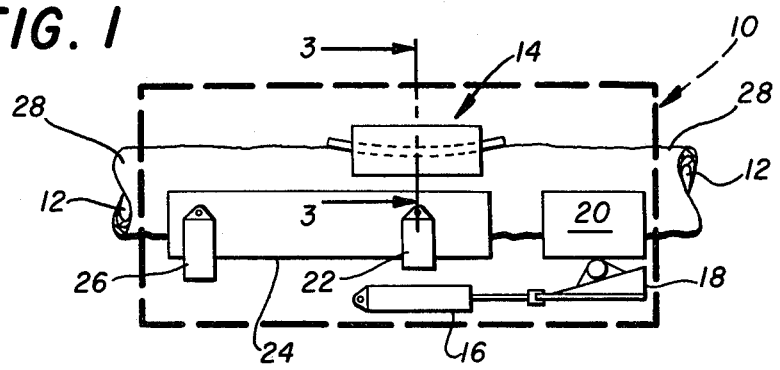
FIG. 1 is a schematic illustration of a pipe bending machine in which the present invention may be employed.

Referring now to the Drawings, wherein like reference characters designate like or corresponding parts throughout several views, FIG. 1 illustrates a pipe bending machine 10 in which the present invention may be incorporated. One such machine is described and illustrated in U.S. Pat. No. 3,834,210 issued Sept. 10, 1974 which disclosure is hereby incorporated by reference.

A pipe 12 to be bent is moved into the machine 10 and positioned under the bending die 14 at the point where the bend is to commence. A pin-up cylinder 16 forces a wedge 18 underneath a pin-up shoe 20. The pin-up shoe 20 moves upwardly to engage the pipe 12.

An inboard cylinder 22 acts between the frame of the machine 10 and a stiffback 24. The inboard cylinder 22 urges the stiffback up to push the pipe against the bending die 14. An internal mandrel 25 may be positioned within the pipe as shown to support the pipe walls during bending. Such a mandrel is disclosed and illustrated and its operation described in U.S. Pat. No. 3,834,210 and U.S. Pat. No. 3,851,519 which disclosures are herein incorporated by reference. With the bending die acting as the fulcrum, the outboard cylinder 26 pushes the outer end of the stiffback up, bending the pipe.

Figure 2:
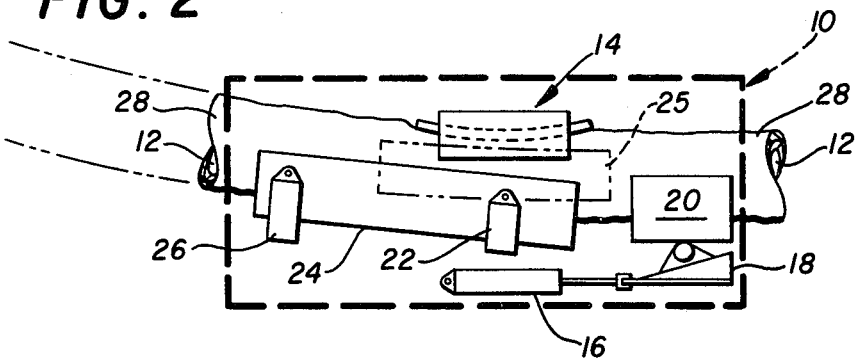
FIG. 2 is a schematic view of the pipe bending machine showing the configuration after bending.

After each bending operation, the pipe 12 is moved through machine 10 toward the pin-up shoe a given increment. The operation is then repeated until the desired angle of bend is achieved. The pipe 12 is always moved toward the pin-up shoe 20 during bending to keep a straight portion of the pipe in the stiffback 24. The pipe and stiffback after bending are illustrated in FIG. 2.

The stiffback, bending die and pin-up shoe each have a cross section transverse to the length of the machine and pipe which conforms to the outer surface of the pipe. Therefore, to adapt the machine 10 for use with pipes of varied diameters, it is necessary to position a properly sized bending die 14 in the machine. A set of liners may be employed in the stiffback and pin-up shoe to adapt the machine for varied diameter of pipe.

The pipe 12 illustrated in FIG. 1 includes a layer of compressible material 28 which forms a coating about the pipe. The compressible material 28 may, for example, be a polyurethane foam for insulation. The bending die 14 shown in FIGS. 1–4 forms a first embodiment of the present invention. This die acts to bend the coated pipe without failure of the coating material and simultaneously prevents distortion or wrinkling of the pipe at the bend.

Figure 3:
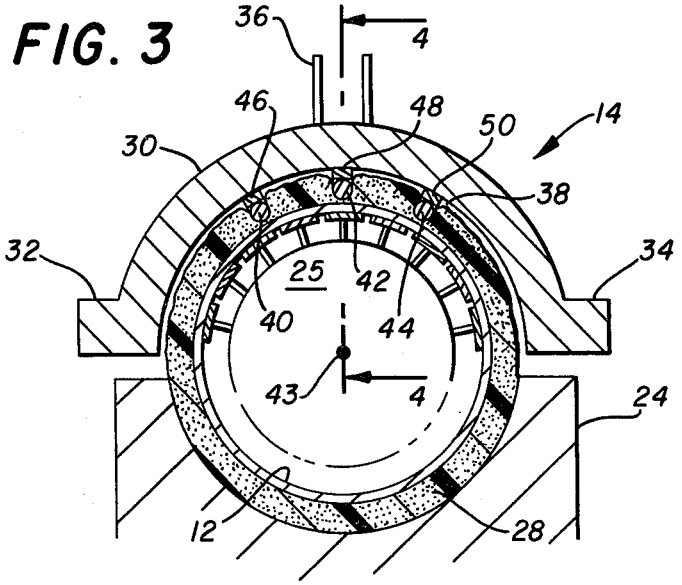
FIG. 3 is a front view of a bending die incorporating a first embodiment of the present invention.
Figure 4:
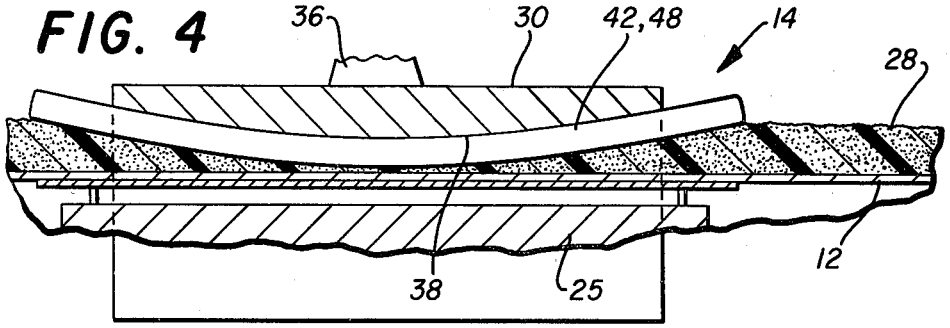
FIG. 4 is a side vertical cross section of the bending die of FIG. 3.

The bending die 14 is best described with reference to FIGS. 3 and 4. The die 14 illustrated incorporates a conventional bending die 30. The conventional die has a general semi-cylindrical shape with lugs 32 and 34 at the outer edges thereof for securing the die within the machine 10 when the stiffback is operated to bend the pipe. Lugs 36 are positioned at the upper portion of the die to suspend the die in the machine when not operating.

Figure 7:
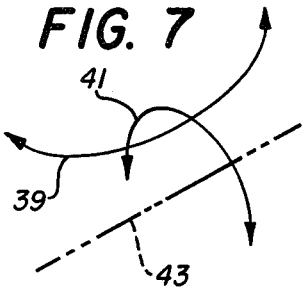
FIG. 7 illustrates the longitudinally convex transversely concave curve of the inner surface of a conventional die.

The conventional die includes a compound curved inner surface 38. As shown in FIG. 7, the compound surface includes a longitudinally convex bearing curve 39 which is positioned along the axis 43 of the pipe during bending. The curve 39 is curved at a radius to achieve the curvature desired in the pipe after bending. The surface 38 is also transversely concave along curve 41 to conform to the outer curvature of the pipe.

The die 30 is modified to form the bending die 14 by placing three bars forming rods 40, 42 and 44 extending longitudinally along the surface 38 of the conventional die. The rods are secured to the conventional die through spacer bars 46, 48 and 50, respectively.

When the pipe 12 is urged against the bending die 14, the rods 40, 42 and 44 compress the material 28 as shown in FIG. 2. The lower surface of each rod is curved to prevent cutting the material 20 as it is compressed. As the material under the rods is compressed, portions of a material expand outward between the rods and spacer bars to relieve the stress in the material. The rods and spacer bars are positioned about the circumference of the pipe at a sufficient distance to permit the material to expand between them without causing a rupture of the coating.

As the material is compressed, a sufficiently rigid contact is made between the rods and upper portion of the pipe to support the pipe as it bends.

The rods 40, 42 and 44 are curved longitudinally to form the desired radius of curvature in the pipe during bending. This curvature is best illustrated in FIG. 4. In the die 14 illustrated, the conventional die 30, spacer bars and rods are separate components. The components may, for example, be welded to form the die 14 or secured in any other suitable fashion. However, it is also possible to form the rods and spacer bars as an integral unit or even to form the entire die 14 as a single unit. While the rods 40, 42 and 44 have been shown with a circular cross section, the rods may have any suitable cross section which does not tend to cut the material 28 compressed thereby during bending. The cross section may, for example, be an oval, square or rectangle. The rods should be designed, however, with a cross section permitting sufficient compression of material beneath the rod to permit firm support of the pipe by the bending die.

The invention as embodied by the bending die 14 has several significant advantages in the bending of coated pipe. As previously noted, the use of the rods 40, 42 and 44 permit the pipe to be supported during bending in a rigid manner sufficient to prevent distortion or wrinkling of the pipe. In fact, the die 14 may be effective enough to permit the bending of pipe without an internal mandrel supporting the pipe during bending. This would provide substantial savings in time and cost in procuring and positioning the mandrel. The rods further subject acceptable stresses to the compressible material 28 forming the coating around the pipe. Even if the rods cut through the coating, the cuts will be limited in area and of little concern.

The bending die 14 may be constructed with the use of a conventional die 30 by merely securing the rods and spacer bars along its inner surface. This permits an operator to employ preexisting equipment to minimize cost. The rods and spacer bars may also be removable to permit the traditional use of die 30. The conventional die used would be adapted for bending a pipe of greater radius than the bending die 14 so that the rods and spacer bars may be positioned thereon. In one application of the present invention, pipes having a diameter of 24 inches with a two inch outer polyurethane foam coating were bent. A conventional die for bending 30 inch diameter pipe was used. The rods were formed of material having a diameter between 1 and 1¼ inch in diameter and centered 1 to 1½ inch off the inner surface of the conventional die.

Figure 5:
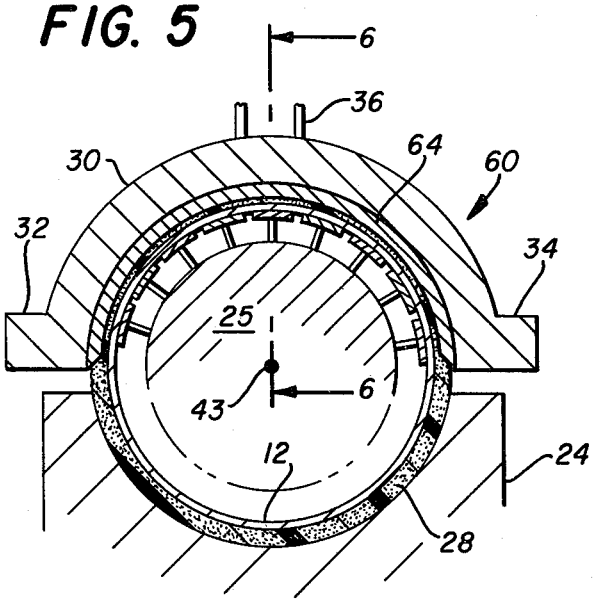
FIG. 5 is a front view of a bending die incorporating a second embodiment of the present invention.
Figure 6:
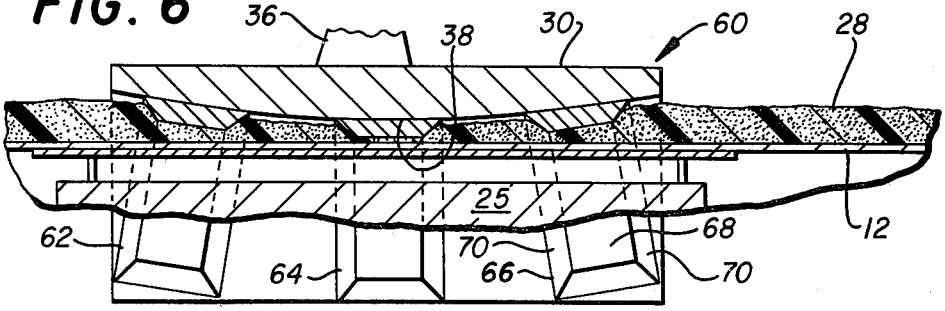
FIG. 6 illustrates a vertical cross section of the bending die incorporating the second embodiment.

A second embodiment of the present invention is illustrated in FIGS. 5 and 6. The bending die 60 forming the second embodiment includes a conventional die 30 and a plurality of semiannular rings 62, 64 and 66 extending in the transverse direction. The operation of die 60 is substantially identical to that of die 14. The lower surface 68 and side walls 70 of each ring compress the material 28 as the pipe is bent. Sufficient space is provided between the rings longitudinally along the die to permit the adjacent material to flow outward between the rings to relieve stress on the coating. While three rings are shown in FIGS. 5 and 6, any suitable number may be provided. When rings 62, 64 and 66 are mounted, the middle ring 64 may be spaced from the die or made of greater thickness than the end rings to permit the pipe to be bent to a desired radius of curvature.

Figure 8:
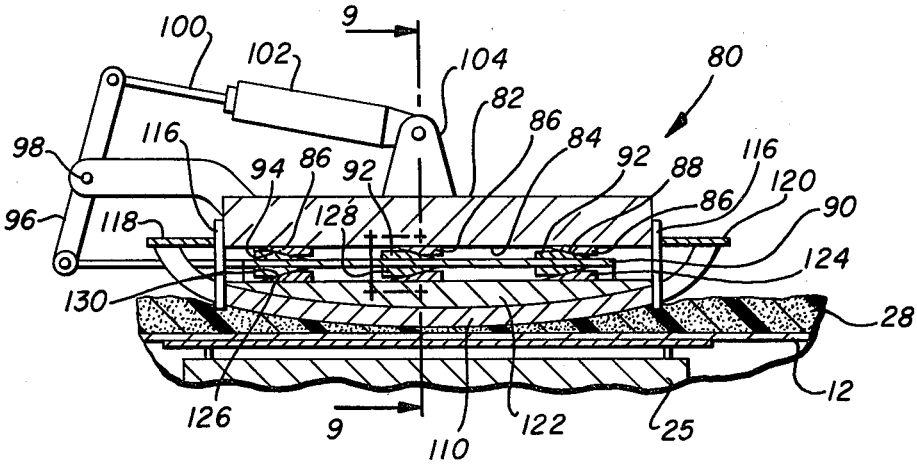
FIG. 8 is a side vertical cross section of the bending die incorporating a third embodiment of the present invention.
Figure 9:
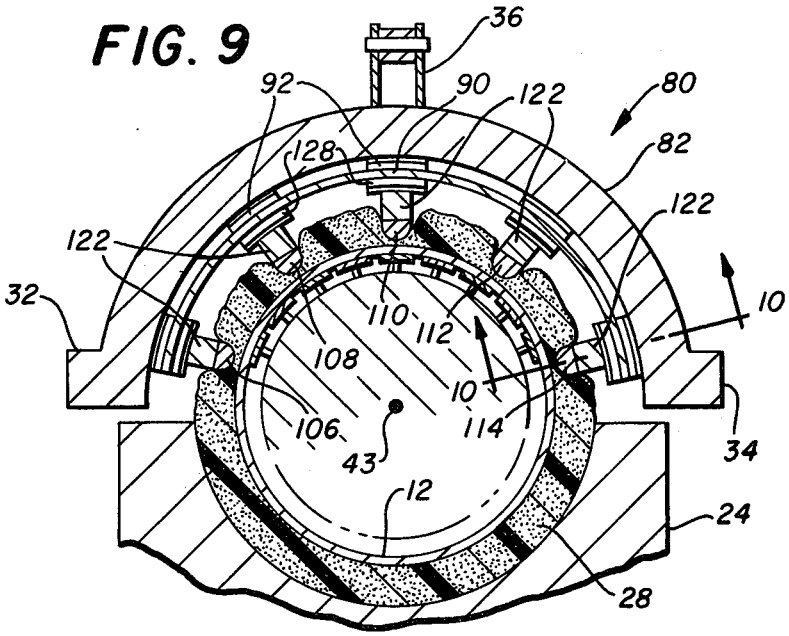
FIG. 9 is a front view of a bending die incorporating the third embodiment.
Figure 10:
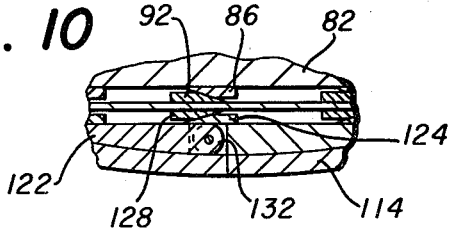
FIG. 10 is a detail view of the pivotable bar of the bending die of the third embodiment.

A third embodiment of the present invention is illustrated in FIGS. 8 and 9 and forms a bending die 80. The bending die 80 includes a support structure 82 for securing the die to the bending machine 10. The inner surface 84 of the support structure forms a semi-cylinder curved in the transverse direction and having a radius larger than the pipe to be bent. A series of wedges 86 are secured along longitudinal lines on the inner surface 84. The wedges each include an inclined face 88 facing one end of the die. In the embodiment shown, five groups of wedges are provided longitudinally.

A resilient annular sleeve 90 is positioned radially inward of the wedges 86 and includes wedges 92 with inclined faces 94 to cooperate with the faces 88. A portion of the sleeve 90 extends from one end of the die and is pivotally connected to an activating arm 96. The activating arm is hinged by pin 98 to the support structure 82 along its length. The end opposite the sleeve extension is pivotally secured to the piston 100 of a fluid cylinder 102. The fluid cylinder 102, in turn, is pivotally secured to a bracket 104 on the support structure 82. Actuation of the fluid cylinder 102 in a first direction to extend the piston 100 urges the sleeve 90 to the right as shown in FIG. 8. As the sleeve moves to the right, the cooperating faces engage and move the sleeve radially inward.

A number of rods 106, 108, 110, 112 and 114 are positioned about the inner surface of the bending die 80 as shown. The rods are guided for radial motion within guides 116 secured to the support structure 82. The radial motion is centered on the center axis 43 of the pipe when positioned in the machine for bending. Spring bands 118 and 120 interconnect the ends of each of the rods and urge the rods radially outward toward the inner surface 84. A spacer bar 122 is secured at the back of each rod. The spacer bars are curved to adapt to the longitudinal curved shape of the rods as best illustrated in FIG. 8. The upper surface of each spacer bar 122 includes wedges 124 with inclined faces 126 for cooperating with wedges 128 having inclined faces 130 on the radially inner portion of the sleeve 90.

As can be readily understood from FIGS. 7 and 8, motion of the piston in the first direction will cause wedges 86, 92, 124 and 128 to urge the rods radially inward to compress the material 28 and support the pipe during bending. The use of bending die 80 permits the pipe 12 to be supported around a greater circumferential arc in the transverse direction.

During operations the cylinder 102 is activated in the opposite direction. The rods move radially outward under the influence of the spring bands 118 and 120, so that the pipe 12 may be positioned within the bending machine 10 for bending without the material 28 being torn or rendered through contact with the rods prior to bending. Once positioned, the cylinder may be actuated in the first direction to close the rods about the pipe so that the rods move substantially radially inward toward the center axis of the pipe and compress the minimum of material to provide support. Again, the rods are spaced at a sufficient transverse distance to permit the material to flow outward between the rods during bending.

The rods 106 and 114 closest the sides of the pipe 12 may be separated at their midpoint and then associated spacer bars 122 separated at their midpoint by a hinge member 132. The hinge member permits the two halves of the rods to pivot relative to each other as the pipe is bent. This alleviates the potential for tearing the material 28 in shear as the pipe is bent from its initial position.

The inclined wedges of bending die 80 form one mechanism for moving the rods radially inward to compress the material and support the pipe during bending. However, other suitable mechanisms may be employed. For example, camming devices may be positioned between the inner surface 84 and spacer bars 122 for rotational motion about longitudinal axes. Rotation of the camming members to vary the distance between the inner surface 84 and spacer bars 122 may be used to create the desired radial motion of the rods. In a second example, the rods and spacer bars may be connected to a linkage extending outside the support structure 82. The linkage may be activated to urge the rods in the radial direction.

Although several embodiments of the invention have been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

We claim:

1. A bending die for use in a pipe bending machine for pipe coated with a compressible material comprising:
   support structure for mounting on the pipe bending machine and having an inner surface;
   a plurality of bars arranged along said inner surface of said support structure in pipe confronting relation for opposing bending forces through said compressible material, said bars being sufficiently spaced apart for flow of said compressible material between said bars as bending forces cause deformation of said compressible material to resist damage to the compressible material by relieving the stress in the compressible material.

2. The pipe bending die of claim 1 in which said bars are rigidly mounted to said die and longitudinally curved to produce the radius of curvature desired in the pipe after bending.

3. The pipe bending die of claim 1 in which said bars are rigidly mounted to said die and transversely curved and longitudinally spaced to define a curve to produce the radius of curvature desired in the pipe.

4. The pipe bending die of claim 1 in which said support structure is removably mounted in a die holder so that the pipe bending machine may be adapted for bending pipe within a range of sizes by mounting an appropriately sized bending die to said pipe bending machine.

5. A bending die for use in a pipe bending machine for pipe coated with a compressible material comprising:
   support structure for mounting the die on the pipe bending machine and having an inner surface;
   a plurality of bars extending along said inner surface of said support structure in pipe confronting relation for opposing bending forces through said compressible material, said bars being spaced apart for flow of said compressible material between said bars as bending forces cause deformation of said compressible material; and said bars being floatably mounted to said die and moveable radially inward against the pipe to minimize shearing forces in said compressible material and which predeform the compressible material prior to bending.

6. The pipe bending die of claim 5 in which spring structure interconnects adjacent ends of said bars and urges said bars radially outward, and said die further having a longitudinally slidable curved member between said inner surface of said support structure and said bars, said curved member having wedge structure for moving said bars radially inward as said curved member is moved in a first longitudinal direction.

7. A bending die for pipe coated with a compressible material comprising:

structure forming an inverted cradle having a transversely concave longitudinally convex bearing surface for opposing forces applied to said pipe beyond the ends of said cradle;

a plurality of bars extending transversely along said surface of said die in pipe confronting relation for opposing bending forces through said compressible material said bars being sufficiently spaced apart longitudinally for encouraging flow of said compressible material between said bars as bending forces cause deformation of said compressible material.

8. The pipe bending die of claim 7 in which said bars are rigidly mounted to said die and define a longitudinal curve corresponding to the radius of curvature to be produced in the pipe.

9. A bending die for pipe coated with a compressible material comprising:

structure defining an inner surface in pipe confronting relation to the pipe during bending; and a plurality of bars extending longitudinally along said inner surface of said structure and in pipe confronting relation, said plurality of bars defining a transversely concave longitudinally convex bearing surface for opposing forces applied to said pipe beyond the ends of said cradle for opposing bending forces through said compressible material, said bars being sufficiently spaced apart laterally for encourging flow of said compressible material between said bars as bending forces cause deformation of said compressible material.

10. The pipe bending die of claim 9 in which said bars are rigidly mounted to said structure and longitudinally curved to correspond to the radius of curvature to be produced in the pipe.

11. The pipe bending die of claim 9 in which said bars are floatably mounted to said structure and are movable radially inward aginst the pipe to minimize shearing forces in said compressible material which predeform the compressible material prior to bending.

12. The pipe bending die of claim 11 in which bars proximate the transverse edges of the bearing surface are separated into a plurality of discrete sections in the longitudinal direction to permit independent movement of each section with said compressible material as the pipe is bent.

13. The pipe bending die of claim 9 in which spring structure interconnects adjacent ends of said bars and urges said bars radially outward and said die further comprising a longitudinally slidable curved member between said inner surface of said structure and said bars having wedge structure for moving said bars radially inward as said curved member is moved in a first longitudinal direction.

14. The pipe bending die of claim 9 in which said die is removably mounted in a die holder so that the pipe bending machine may be adapted for bending pipe within a range of sizes by mounting an appropriately sized bending die to said pipe bending machine.

15. In a pipe bending machine having a stiffback and pin-up shoe for applying bending stresses to a pipe, the combination comprising:

a bending die having a transversely concave longitudinally convex down facing surface and mounted in a die holder for opposing bending forces applied to a pipe by said stiffback and pin-up shoe;

a plurality of bars extending transversely along said surface of said die and sufficiently spaced apart longitudinally to transmit bending forces between the pipe and said die through a compressible coating on said pipe so that the coating is deformed only adjacent said bars and is permitted to flow between said bars to prevent failure of the coating.

16. The pipe bending machine of claim 15 wherein said bars are rigidly mounted on said die and define a longitudinal curvature corresponding to the desired curvature in the pipe.

17. In a pipe bending machine having a stiffback and pin-up shoe for applying bending stresses to a pipe, the combination comprising:

a structure defining an inner surface in pipe confronting relation to the pipe during bending and mounted to said pipe bending machine;

a plurality of bars extending longitudinally along said inner surface of said structure and spaced apart laterally, said bars defining a transversely concave longitudinally convex down facing surface for opposing bending forces applied to said pipe by said stiffback and pin-up shoe to transmit bending forces between the pipe and said structure through a compressible coating on said pipe, said bars being sufficiently spaced so that the coating is deformed only adjacent said bars and is permitted to flow between said bars to prevent failure of the coating.

18. The pipe bending machine of claim 17 wherein said bars are rigidly mounted on said structure and have a longitudinal curvature corresponding to the desired curvature in the pipe.

19. The pipe bending machine of claim 17 wherein said bars are floatably mounted on said structure and are movable radially inward to precompress said coating prior to bending whereby said radial movement further acts to prevent shearing of the coating as the bending forces are applied to the pipe.

20. The pipe bending machine of claim 19 wherein bars defining the lower ends of said down facing surface are separated into a plurality of sections along their length so that each individual section moves with said compressible material as the pipe is bent independently of the other sections.

21. The pipe bending machine of claim 19 wherein spring structure urges said bars toward said inner surface and said pipe bending machine further having means to urge said bars radially inward toward the pipe comprising cooperating wedges having a first wedge surface acting against a cooperating wedge surface upon longitudinal movement of one wedge surface relative to the other.

22. In a pipe bending machine having a stiffback and a pin-up shoe for applying bending forces to a pipe opposed by an upper bending die having a transversely concave surface mounted in a die holder structure for facilitating the bending of the pipe when coated with a compressible material which comprises:

a plurality of bars floatably mounted on said die and extending longitudinally along said surface of said die in lateral spaced apart relation to transmit said bending forces between said pipe and said die through said material to deform said material only under said bars, said bars being spaced laterally for flow of said compressible material between said bars to prevent failure of the coating;

spring means interconnecting said bars at their ends and urging said bars radially outward;

a curved member mounted for longitudinal slidable motion between said surface and said bars and having wedge surfaces;

wedge surfaces formed on said surface;

means to move said curved member longitudinally to urge said bars radially inward to pre-deform said coating prior to bending and to prevent the application of shear stresses on said coating as the bending forces are applied.

23. The pipe bending machine of claim 22 wherein bars proximate the transverse edges of said die are separated into a plurality of discrete sections along their length and are attached so that the sections move with said compressible material as the pipe is bent to resist shear forces.

24. A method of bending pipe coated with a compressible material against a bending die, the bending die having a plurality of bars arranged along the inner surface of said die in pipe confronting relation, comprising the steps of:

supporting the pipe against said bending die;

precompressing the compressible material with said plurality of bars to oppose bending forces therethrough, said bars being sufficiently spaced apart for flow of said compressible material between said bars to resist damage to the compressible material by relieving the stresses in the compressible material;

bending said pipe about said bending die, said bars defining a curved surface longitudinally to produce the desired radius of curvature in the pipe.

25. The method of claim 24 wherein said bending die includes structure forming an inverted cradle having a transversely concave longitudinally convex bearing surface for opposing forces applied to said pipe beyond the ends of said cradle, the method further comprising the step of securing said plurality of bars longitudinally along said surface of said die, said bars being spaced apart laterally for flow of said compressible material between said bars.

26. The method of claim 24 wherein said bending die includes structure forming an inverted cradle having a transversely concave longitudinally convex bearing surface for opposing forces applied to said pipe beyond the ends of said cradle, the method further comprising the step of securing said bars transversely along said inner surface of said die and spacing said bars longitudinally for flow of said compressible material therebetween.

27. A method of bending pipe coated with a compressible material against a bending die, the bending die having a plurality of bars extending longitudinally along the inner surface of said die in pipe confronting relation and supported for radial motion toward a center axis comprising the steps of:

positioning and supporting the pipe with its longitudinal center axis centered on the center axis;

moving said bars radially inward to precompress the compressible material on said pipe with said plurality of bars to oppose bending forces therethrough, said bars being spaced apart for flow of said compressible material between said bars; and bending said pipe about said bending die, said bars defining a curved surface to produce the desired radius of curvature in the pipe.

* * * * *